United States Patent [19]

Kalaam

[11] Patent Number: 5,010,591

[45] Date of Patent: Apr. 30, 1991

[54] FIRE FIGHTER'S COAT HAVING IMPROVED SLEEVE CONSTRUCTION

[75] Inventor: Shaik M. Kalaam, Scarborough, Canada

[73] Assignee: Safeco Mfg. Limited, Scarborough, Canada

[21] Appl. No.: 502,635

[22] Filed: Apr. 2, 1990

[51] Int. Cl.[5] ..... A41D 3/02

[52] U.S. Cl. ..... 2/93; 2/159

[58] Field of Search ..... 2/81, 85, 93, 59, 125, 2/243 R, 243 B, 16, 163

[56] References Cited

U.S. PATENT DOCUMENTS

| | | | |
|---|---|---|---|
| D. 278,566 | 4/1985 | Gustafson | 2/59 |
| 4,651,348 | 3/1987 | Swanson | 2/93 |
| 4,843,646 | 7/1989 | Grilliot | 2/69 |

FOREIGN PATENT DOCUMENTS

| | | | |
|---|---|---|---|
| 3339648 | 5/1985 | Fed. Rep. of Germany | 2/16 |
| 2116839 | 7/1972 | France | 7/125 |
| 2113976 | 8/1983 | United Kingdom | 2/16 |

*Primary Examiner*—Werner H. Schroeder
*Assistant Examiner*—Diana L. Biefeld
*Attorney, Agent, or Firm*—Fetherstonhaugh & Co.

[57] ABSTRACT

A fire fighter's coat in which the forearm portion of each sleeve is inclined forwardly with respect to the upper arm portion when the sleeve is in a relaxed position, thereby to provide a natural forward set to the sleeve which serves to substantially reduce the resistance offered by the sleeve to movement of the fire fighter's arms to a position required to enable the wearer to bring his hands together to grasp an object located in front of the coat.

3 Claims, 3 Drawing Sheets

FIRE FIGHTER'S COAT HAVING IMPROVED SLEEVE CONSTRUCTION

BACKGROUND OF THE INVENTION

This invention relates to fire fighter's coats. In particular, this invention relates to an improved sleeve structure for a fire fighter's coat.

Fire fighter's coats are normally made from a tough, thermal insulating material which has a degree of flexibility which is substantially less than conventional street clothing. As a result, the fire fighter is required to expend considerable energy in order to bend the arms of the coat to permit the wearer's forearm to be angularly inclined with respect to the upper arm. This angularly inclined position of the forearm with respect to the upper arm is a position which is used very extensively by a fire fighter when, for example, grasping a hose in front of the fire fighter's body in order to direct a fire fighting liquid on to a fire site. It is a position which most people assume more often than not when attempting to manually grasp or manipulate an object with both hands. Little or no difficulty is experienced in attempting to bend the arm of a conventional article of clothing. Fire fighters are, however, required to operate under hazardous conditions and fatigue, particularly arm fatigue, is a major problem, with the result that any reduction in the load applied to the arm of a fire fighter is of considerable value in attempting to reduce fatigue.

U.S. Pat. No. 4,843,646 discloses a fire fighter's garment in which the thickness and bulkiness of the inner liner is reduced in order to increase flexibility. The present invention serves to reduce the need for a great deal of the flexibility of the sleeves of the coat by setting the forearm portion of the sleeve at an angle with respect to the upper arm portion. As a result, it is possible to avoid the need to reduce the bulk and the thermal protective properties of the sleeve of the coat without restricting the ease with which the arm of the fire fighter can bend to a common set position.

SUMMARY OF INVENTION

According to one aspect of the present invention there is provided a fire fighter's coat which comprises a main body portion and a pair of sleeves each made from a tough, thermally insulated fabric which has a degree of flexibility which is substantially less than that of conventional street clothing; said sleeves each having an upper arm portion which has a sleeve passage opening therethrough which has a first axis which extends longitudinally thereof and a forearm portion which has a forearm passage opening therethrough which has a second axis which extends longitudinally thereof, said forearm portion being attached to the upper arm portion in such a manner that said second axis is inclined forwardly with respect to the upper arm portion when the sleeve is in a relaxed position, thereby to provide a natural forward set to the sleeve which serves to substantially reduce the resistance offered by the sleeve to movement of the fire fighter's arms to a position required to enable the wearer to bring his hands together to grasp an object located in front of the coat.

BRIEF DESCRIPTION OF THE DRAWINGS

FIG. 3 is a side view of a sleeve of the coat taken in the direction of the arrow 3.

With reference to FIG. 1 of the drawings, the reference numeral 10 refers generally to a fire fighter's coat constructed in accordance with an embodiment of the present invention. The coat 10 has a body portion 12 of a conventional construction and a pair of sleeves 14. Each sleeve 14 comprises an upper portion 16 and a forearm portion 18. The upper portion 16 has its proximal end connected to the coat at the shoulder and its distal end connected to the proximal end of the forearm portion. As shown on FIG. 3 of the drawings, the upper portion has a longitudinal axis 20 and the forearm portion has a longitudinal axis 22. The axis 20 is located substantially centrally of the sleeve passage which opens through the upper portion and the axis 22 is located substantially centrally of the sleeve passage which opens through the forearm portion. The included angle theta formed between the axis 20 and the axis 22 is preferably about 120°.

Figure 1:
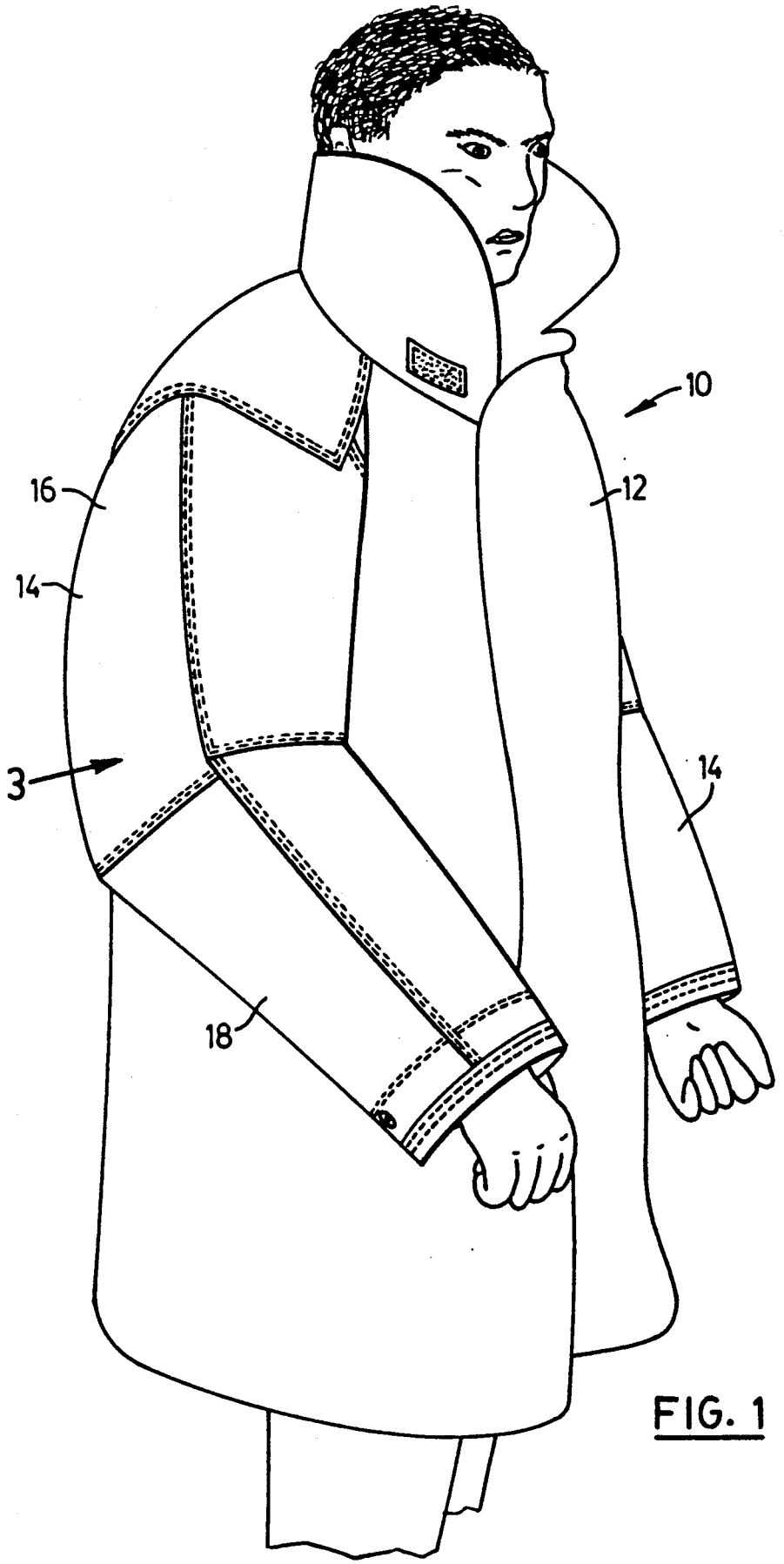
FIG. 1 of the drawings refers generally to a fire fighter's coat constructed in accordance with an embodiment of the present invention.
Figure 2:
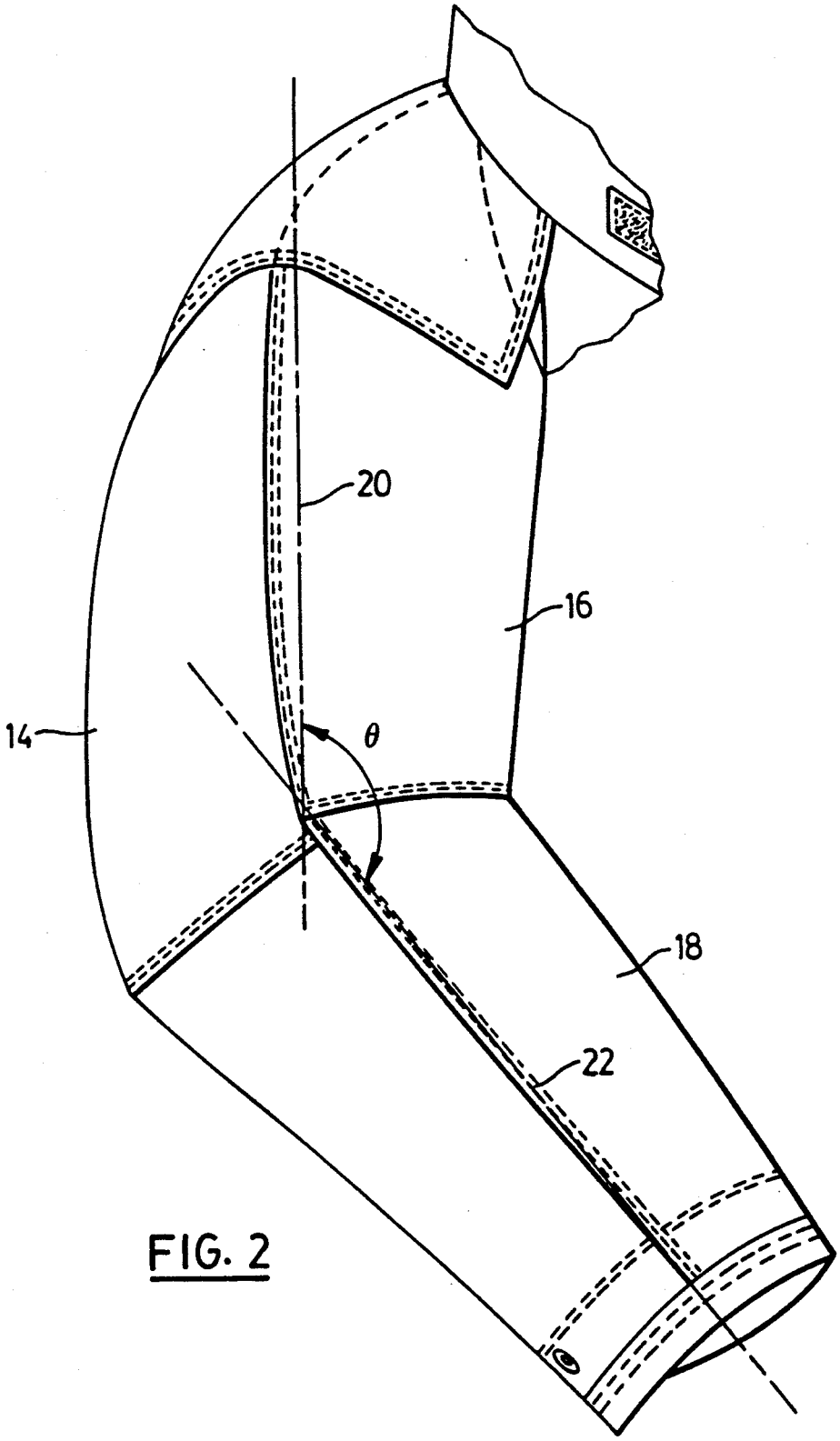
FIG. 2 is a side view of a sleeve of the coat of FIG. 1.
Figure 4:
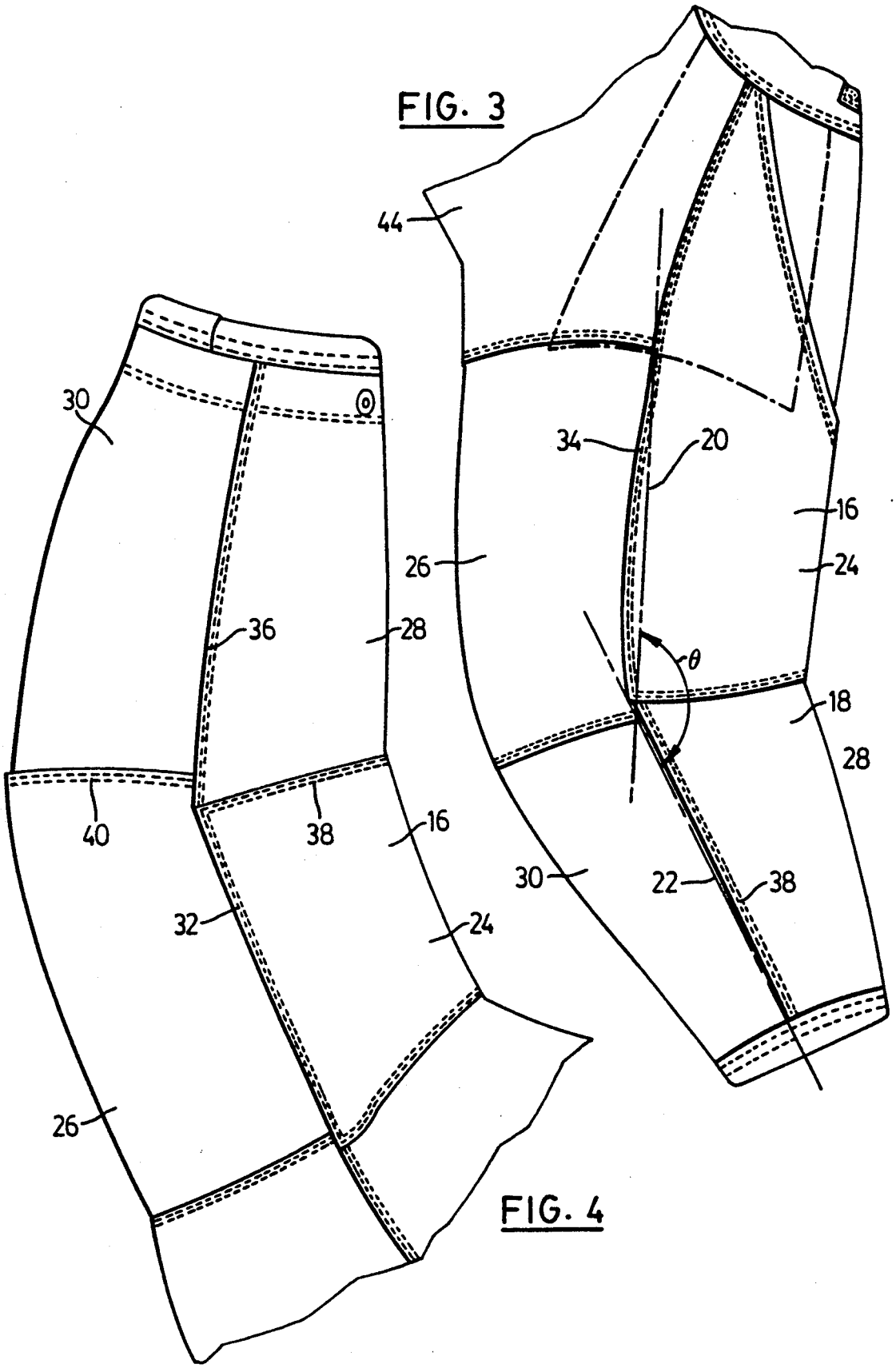
FIG. 4 is a side view of the inner side of the sleeve of FIG. 3.

The upper sleeve portion 16 has a front panel 24 and a back panel 26. The forearm sleeve portion has a front panel 28 and a back panel 30. The front panel 24 and back panel 26 of the upper sleeve portion are secured to one another along first seam lines 32, 34 and the front and back panels of the forearm portion are connected to one another along seam lines 36, 38. The seam lines 32, 34 are located substantially centrally of the width of the inner side face and outer side face respectively of the upper arm portion, and the seam lines 36, 38 are located substantially centrally of the width of the inner side face and outer side face respectively of the forearm portion. The front panels 24 and 28 are connected to one another along a third seam line 38 and the back panels 26 and 30 are connected to one another along a fourth seam line 40. The seam lines 38 and 40 are angularly inclined with respect to one another and serve to provide the angular set to the forearm portion.

By manufacturing the sleeve so that it has four distinct panels, it is possible to achieve a greater length along the back edge of the sleeve rather than along the front edge of the sleeve, thereby to provide the required angular inclination of the sleeve. This form of multi panel construction facilitates the assembly and stitching of the sleeve. As shown in FIG. 3 of the drawings, the upper arm portion of the sleeve is connected to the coat by seam lines which serve to provide a raglan shoulder structure. A protective overlay 44 extends over the raglan shoulder connection.

From the foregoing it will be apparent that the sleeve structure of the fireman's coat of the present invention will normally assume a position in which the forearm portion is downwardly and forwardly inclined as shown in FIG. 1 of the drawings. As a result, it is not necessary to bend the sleeve in order to permit the fireman to assume the arm position shown in FIG. 1. This arm position is closely approximate to the position which a fire fighter would adopt when grasping a hose or any other heavy object which is to be lifted by both hands held in front of the body of the fireman.

It will be apparent that by adopting this preset position, the fire fighter is not required to expend any energy in order to position the arms in this initial set position and this can serve to reduce the fatigue which the fire fighter experiences when bending the sleeves of a fire fighter's coat constructed in accordance with conventional coat construction.

Other advantages of the structure of the present invention will be apparent to those skilled in the art. For example, the ease with which the sleeve can be assembled results from the fact that it is made from four distinct panels which are stitched together along the various seam lines identified.

These and other advantages of the present invention will be apparent to those skilled in the art.

I claim:

1. A fire fighter's coat comprising:

a main body portion and a pair of sleeves each made from a tough, thermally insulated fabric which has a degree of flexibility which is substantially less than that of conventional street clothing; said sleeves each having an upper arm portion which has a sleeve passage opening therethrough which has a first axis which extends longitudinally thereof and a forearm portion which has a forearm passage opening therethrough which has a second axis which extends longitudinally thereof, said forearm portion being attached to the upper arm portion in such a manner that said second axis is inclined forwardly with respect to the upper arm portion when the sleeve is in a relaxed position, thereby to provide a natural forward set to the sleeve which serves to substantially reduce the resistance offered by the sleeve to movement of the fire fighter's arms to a position required to enable the wearer to bring his hands together to grasp an object located in front of the coat, the upper sleeve portion and the forearm portion of each sleeve having a front panel and a back panel, the front and back panels of the upper portion being secured to one another along first seam lines which extend longitudinally thereof and the front and back portions of the forearm portion being secured to one another along second seam lines which extend longitudinally thereof, the front panel of the upper portion being secured to the front panel of the forearm portion along a third seam line and the back panel of the upper portion being secured to the back panel of the forearm portion along a fourth seam line, said third and fourth seam lines being angularly inclined with respect to one another to provide the angular inclination of the forearm portion with respect to the upper portion.

2. A fire fighter's coat as claimed in claim 1 wherein the first seam lines of the upper portion extend centrally of the width of the outer and inner side faces thereof and the second seam lines extend centrally of the width of the inner and outer side faces of the forearm portion.

3. A fire fighter's coat comprising:

a main body portion and a pair of sleeves each made from a tough, thermally insulated fabric which has a degree of flexibility which is substantially less than that of conventional street clothing; said sleeves each having an upper arm portion which has a sleeve passage opening therethrough which has a first axis which extends longitudinally thereof and a forearm portion which has a forearm passage opening therethrough which has a second axis which extends longitudinally thereof, said forearm portion being attached to the upper arm portion in such a manner that said second axis is inclined forwardly with respect to the upper arm portion when the sleeve is in a relaxed position, thereby to provide a natural forward set to the sleeve which serves to substantially reduce the resistance offered by the sleeve to movement of the fire fighter's arms to a position required to enable the wearer to bring his hands together to grasp an object located in front of the coat, the included angle between the first axis and the second axis being no more than 120°.

* * * * *